US007111878B2

(12) United States Patent
Kachouh

(10) Patent No.: US 7,111,878 B2
(45) Date of Patent: Sep. 26, 2006

(54) MOTOR VEHICLE LOCK

(75) Inventor: Checrallah Kachouh, Dortmund (DE)

(73) Assignee: Brose Schliesssysteme GmbH & Co. KG, Wuppertal (DE)

( * ) Notice: Subject to any disclaimer, the term of this patent is extended or adjusted under 35 U.S.C. 154(b) by 123 days.

(21) Appl. No.: 10/803,085

(22) Filed: Mar. 18, 2004

(65) Prior Publication Data

US 2004/0227358 A1 Nov. 18, 2004

(30) Foreign Application Priority Data

Mar. 20, 2003 (DE) ..... 103 12 304

(51) Int. Cl.
*E05C 3/06* (2006.01)

(52) U.S. Cl. ..... 292/216; 292/201; 292/DIG. 23

(58) Field of Classification Search ..... 292/201, 292/216, DIG. 23; 70/275, 277, 278.7, 279.1; 49/280

See application file for complete search history.

(56) References Cited

U.S. PATENT DOCUMENTS

| | | | | | |
|---|---|---|---|---|---|
| 3,347,584 | A | * | 10/1967 | Johnstone | 292/198 |
| 3,386,761 | A | * | 6/1968 | Johnstone et al. | 292/201 |
| 3,612,593 | A | * | 10/1971 | Bessette | 292/216 |
| RE27,390 | E | * | 6/1972 | Allen | 292/201 |
| 4,203,621 | A | * | 5/1980 | Noel et al. | 292/216 |
| 4,258,945 | A | | 3/1981 | Pouget | |
| 4,298,223 | A | * | 11/1981 | Raffelsiefer et al. | 292/216 |
| 4,395,064 | A | * | 7/1983 | Bellot et al. | 292/201 |
| 4,518,180 | A | * | 5/1985 | Kleefeldt et al. | 292/201 |
| 4,783,102 | A | * | 11/1988 | Bernard | 292/216 |
| 4,948,184 | A | * | 8/1990 | Weyerstall et al. | 292/216 |
| 4,978,153 | A | * | 12/1990 | Hirsch et al. | 292/201 |
| 5,092,639 | A | | 3/1992 | Di Giusto | |
| 5,423,582 | A | * | 6/1995 | Kleefeldt | 292/201 |
| 5,979,951 | A | * | 11/1999 | Shimura | 292/216 |
| 6,079,237 | A | * | 6/2000 | Hochart | 70/278.6 |
| 6,378,920 | B1 | * | 4/2002 | Ostrowski et al. | 292/216 |
| 6,540,271 | B1 | * | 4/2003 | Kalsi | 292/216 |
| 6,557,910 | B1 | * | 5/2003 | Amano | 292/201 |
| 6,659,515 | B1 | * | 12/2003 | Raymond et al. | 292/201 |
| 6,773,042 | B1 | * | 8/2004 | Spurr et al. | 292/216 |

FOREIGN PATENT DOCUMENTS

| | | | |
|---|---|---|---|
| DE | 19902561 | * | 8/2000 |
| DE | 200 16 292 U1 | | 1/2001 |
| DE | 19944615 | * | 4/2001 |
| DE | 102 36 282 A1 | | 3/2003 |
| EP | 0 406 777 B1 | | 1/1991 |

(Continued)

*Primary Examiner*—Brian E. Glessner
*Assistant Examiner*—Carlos Lugo
(74) *Attorney, Agent, or Firm*—David S. Safran

(57) ABSTRACT

A motor vehicle lock includes a latch and a ratchet arrangement. The latch is able to swivel around a swivelling axis, and be moved into an open position, a main locked position and optionally a preliminary locked position. The ratchet arrangement is able to be moved into at least one holding position and into a release position. The ratchet arrangement when in the holding position, keeps the latch, in any case, in the main locked position. The ratchet arrangement includes ratchet kinematics and an adjustable blocking element. By resetting the latch out of the main locked position in the direction of the open position the ratchet kinematics is moved and when the ratchet arrangement is in the holding position the blocking element blocks the movement of the ratchet kinematics which can be caused by the latch and thus blocks the resetting of the latch.

26 Claims, 4 Drawing Sheets

FOREIGN PATENT DOCUMENTS

| | | | |
|---|---|---|---|
| EP | 0 589 158 A1 | | 3/1994 |
| GB | 2112443 | * | 7/1983 |
| GB | 2162234 | * | 1/1986 |

* cited by examiner

MOTOR VEHICLE LOCK

BACKGROUND OF THE INVENTION

1. Field of the Invention

The invention relates to a motor vehicle lock with a latch and a ratchet arrangement.

2. Description of Related Art

Current motor vehicle locks are generally equipped with a latch and a ratchet, in order to accomplish a non-positive connection to a striker which is located on the motor vehicle body as shown in EP 0 589 158 A1. The latch can be swivelled around a swivelling axis and, in any case, can be moved into a main locked position. The ratchet is hook-shaped and keeps the latch in the main locked position by fitting into a corresponding shape, i.e., a main catch on the latch. The basic concept is also used in motor vehicle locks with a motorized opening drive, as is also shown in EP 0 589 158 A1.

Basically, in the above-described motor vehicle lock, a problem arises in which, depending on the configuration of the latch and the ratchet, the lifting of the ratchet and thus the release of the latch are associated with a certain minimum force and a certain minimum work which are determined essentially by the friction force between the latch and the ratchet, while the ratchet is being lifted. In addition to the coefficient of friction, for the work consumed by friction, the reset force acting on the ratchet from the latch, and the adjustment path necessary for lifting the ratchet are decisive.

While maintaining the described basic concept, a reduction of the friction force and the work consumed by friction is possible only to a limited degree without endangering the operating reliability of the motor vehicle lock. This leads to possible adverse effects with regard to ease of operation due to high actuating forces in a mechanically actuated motor vehicle lock. When the motor vehicle lock is equipped with a motorized opening drive, the opening drive can be designed accordingly for high forces or powers. However, this leads to high space requirements and to high costs.

One approach to reduce the force necessary for lifting the ratchet is shown by a known motor vehicle lock described in DE 102 36 282 A1 which shows a ratchet arrangement consisting of two ratchets. The first ratchet can be caused to engage the latch in order to keep the latch in the main locked position. The second ratchet can be caused to engage the first ratchet in order to keep in its holding position. The first ratchet is loaded in the direction of its holding position with a spring, which is overdimensioned for this purpose.

The disadvantage in this motor vehicle lock is that the motion of the ratchets must be matched very exactly to one another so that the motor vehicle door does not swing back when closing, caused by overly slow motion of the first ratchet. The matching of the ratchets to one another makes the structure of the motor vehicle lock complex and takes place by means of a spring with high stiffness. This however leads to the actuating forces for lifting the ratchet being increased. The force which is necessary for lifting the ratchet is reduced by the reduction of the friction force, but this reduction is again neutralized at least partially by the high stiffness of the springs.

Another approach to reducing the force necessary to lift the ratchet is shown by the known motor vehicle lock described in EP 0 406 777 B1 corresponds to U.S. Pat. No. 5,092,639, which underlies this invention. Here, a ratchet arrangement which, like the above described ratchet, can be caused to engage the latch in order to keep the latch in the main locked position. The ratchet arrangement consists of a first lever to which a second lever is coupled with a swivelling capacity. The engagement necessary to hold the latch between the ratchet arrangement on one hand, and the latch on the other, takes place via the second lever. To release the latch, the first lever is swivelled which leads to swivelling of the second lever relative to the first lever. At the same time, the second lever rolls off the latch, to a certain extent, until an unstable state is formed, and the latch swivels into its open position. The work consumed by friction can be largely avoided by the swivelling of the second lever when the latch is released.

The problem in this motor vehicle lock resides in the fact that the operating reliability, when the latch is in the main locked position, cannot be adequately ensured. At high external accelerations, the second lever can swivel and lead to unwanted release of the latch. In order to achieve high operating reliability, high pretensioning of the second lever against the first lever would be necessary, which can lead to a high force which is necessary to release the latch.

SUMMARY OF THE INVENTION

An object of the present invention is to provide a motor vehicle lock where the force or work necessary to be applied to release the latch is reduced to a minimum, with high operating reliability.

This object is achieved with a motor vehicle lock with a latch and a ratchet arrangement. The latch is able to swivel around a swivelling axis, where the latch is able to be moved into an open position and at least into a main locked position. The ratchet arrangement is able to move into at least one holding position and into a release position, and the ratchet arrangement which is in the holding position keeping the latch in the main locked position. The ratchet arrangement has ratchet kinematics and an adjustable blocking element, and by resetting the latch out of the main locked position in the direction of the open position, the ratchet kinematics is moved. When the ratchet arrangement is in the holding position, the blocking element blocks the movement of the ratchet kinematics, which can be caused by the latch, and blocks the resetting of the latch.

First of all, it is important that the resetting of the latch out of the main locked position in the direction of the open position causes movement of the ratchet kinematics of the ratchet arrangement. When the ratchet arrangement is in the at least one holding position, an adjustable blocking element of the ratchet arrangement blocks the movement of the ratchet kinematics, which can be caused by the latch and the resetting of the latch.

The term "ratchet kinematics" is defined comprehensively here as any mechanism that is connected between the latch and the blocking element. When the ratchet kinematics is designed in accordance with the present invention, the force necessary to release the latch, specifically the force for moving the blocking element, can be reduced.

For a mechanically actuated motor vehicle lock, the advantage associated with the present invention arises from the fact that actuating forces necessary for releasing the latch are low and the lever chains from the ratchet arrangement, especially from the adjustable blocking element, as far as to an outside actuating lever or to an inside actuating lever, can be designed to be comparatively weak. Plastic materials can also be advantageously used here due to the low actuation forces. This also relates to connecting elements such as sheathed cables or rods to the outside door handle or to an inside door handle and the outside door handle or inside door handle itself.

There are a number of possibilities for embodying and developing the present invention.

With a configuration of the ratchet kinematics as step-down gearing, the blocking force to be applied by the blocking element can be reduced. Due to the low blocking force, only a small overlap between the blocking element and the respective element of the ratchet kinematics to be blocked is necessary. The work required to release the latch can be further reduced by the reduction of the adjustment path of the blocking element.

The approach, as set forth in the invention, is also advantageous for a motor vehicle lock with a motorized opening drive. By reducing the force or work required for release of the latch, a drive with only small power and, accordingly, with low actuating currents is needed. Furthermore, with electrical actuation it is now possible to reduce the actuating times for low power drives.

Furthermore, for the aforementioned electrical actuation, it is also possible to ensure motorized release of the latch both in normal operation at low seal counterpressures and in emergency operation at high door counterforces (crash case), since the force which must be applied to release the latch is reduced based upon the design of the ratchet kinematics.

The configuration, as provided by the present invention, leads to the fact that the latch, with the intermediate lever, forms a four-bar mechanism with which largely any step-down ratios can be set. With this simple adjustability of speed reduction, especially with the variable speed reduction depending on the position of the latch, the ratchet arrangement can be optimally matched to any respective application.

The swivelling connection of the intermediate lever to the latch obviates the necessity of direct blocking engagement between the ratchet arrangement and the latch. This yields improved tensile strength of the motor vehicle lock especially in the direction of the lengthwise axis of the motor vehicle when high forces act perpendicularly to the flat side of the latch. The swivelling connection of the intermediate lever to the latch largely prevents the latch from sliding past the blocking element. Basically, this consideration also applies with respect to the tensile strength of the motor vehicle lock transversely to the lengthwise axis of the motor vehicle.

Furthermore, because the intermediate lever is coupled to the latch with a swivelling capacity, the surface of the latch can be made mostly in any manner. An especially hard surface of the latch is not necessary, which leads to the possibility of configuring the surface of the latch with respect to optimum tensile strength and at low costs.

It should be pointed out all embodiments of the present invention make weight reduction possible, either by using lighter plastic materials or by designing certain components to be less "massive" or by using smaller drives.

The invention is explained below using drawings which show simply embodiments.

DETAILED DESCRIPTION OF THE INVENTION

FIGS. 1 to 4 show a motor vehicle lock with a latch 2 which holds the striker 1, and with a ratchet arrangement 3. In accordance with exemplary embodiments of the invention, the term motor vehicle lock includes all types of door, hood and hatch locks associated with motor vehicles. The latch 2 can be swivelled around a swivelling axis 4 and can be moved into the open position shown in FIG. 3 and into the main locked position shown in FIG. 1. For limiting of the swivelling motion of the latch 2 in the locking process there is furthermore a stationary stop 2*a*. For side door locks, the latch 2 can be additionally moved into a preliminary locked position (shown in FIG. 2). The ratchet arrangement 3 can be moved into a holding position, shown in FIGS. 1 and 2 and into a release position, shown in FIG. 3. Referring again to FIG. 1 the ratchet arrangement 3, which is in the holding position, keeps the latch 2 in the main locked position and, if provided, in the preliminary locked position. In doing so, the ratchet arrangement 3 for holding the latch 2 in the main locked position can be moved into a first holding position and to hold the latch 2 in the preliminary locked position and can be moved into a second holding position. But, in accordance with another exemplary embodiment of the invention, there can also be a single holding position.

Figure 1:
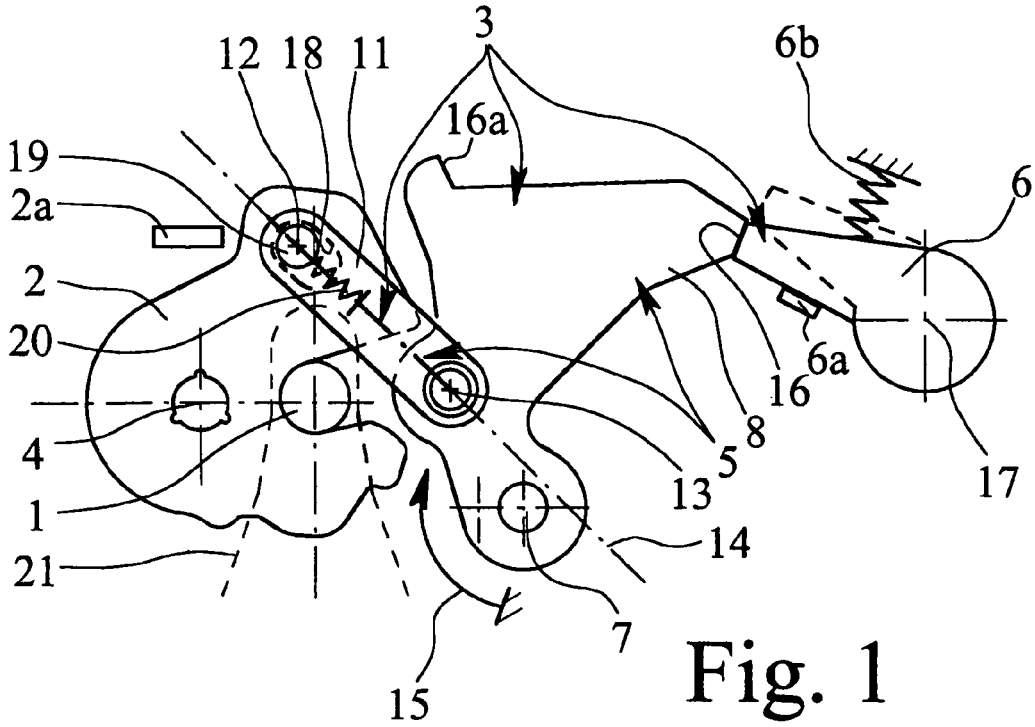
FIG. 1 shows a motor vehicle lock with a latch in the main locked position and a ratchet arrangement in the holding position.

The ratchet arrangement 3 includes ratchet kinematics 5 and an adjustable blocking element 6. By a coupling between the latch 2 and the ratchet kinematics 5, the resetting of the latch 2 out of the main locked position shown in FIG. 1, in the direction of the open position shown in FIG. 3, causes a corresponding movement of the ratchet kinematics 5. When the ratchet arrangement 3, as shown in FIG. 1, is in the holding position, the blocking element 6 blocks the movement of the ratchet kinematics 5 which can be caused by the latch 2, and thus the resetting of the latch 2. The advantages of this configuration of the ratchet arrangement 3 were explained above in the Summary of the Invention.

In one configuration, the ratchet kinematics 5 can be made as step-down gearing so that the blocking force, which is to be applied by the blocking element 6 for blocking the latch 2, is reduced according to the design of the step-down gearing. Here the concept "step-down gearing" means that the amount of reset force which acts on the ratchet kinematics 5 by the latch 2 is greater than the resulting force acting on the blocking element 6 from the ratchet kinematics 5.

Figure 7:
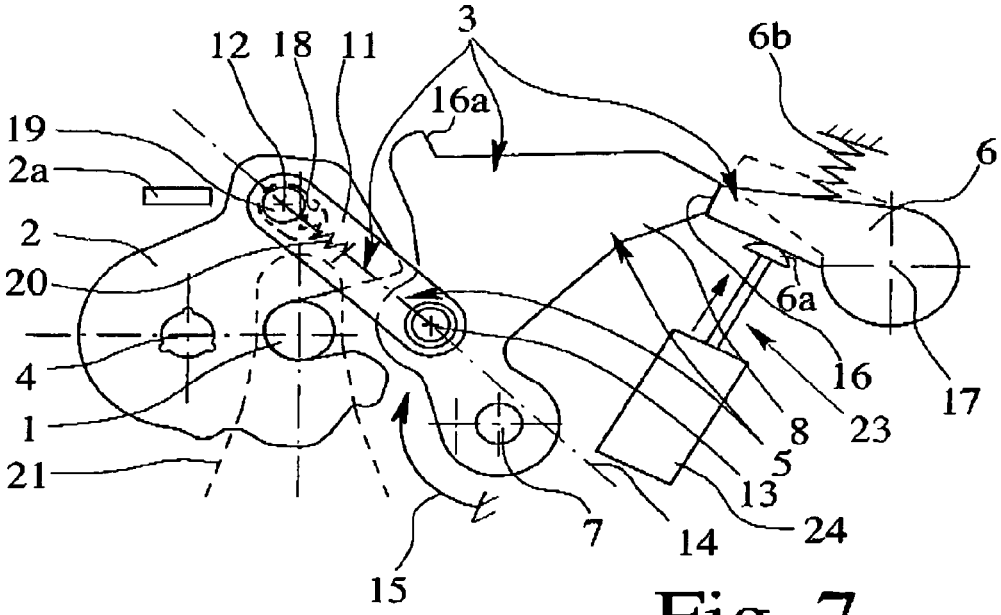
FIG. 7 shows the motor vehicle lock with the latch as shown in FIG. 1 with a motorized opening device.

It was likewise explained above in the Summary of the Invention that the configuration of the motor vehicle lock with a motorized opening drive, in conjunction with the described ratchet arrangement 3, is especially advantageous. Here, the release of the latch 2 can be triggered by the fact that an opening drive, including a motorized opening driver 23 and a motor 24 shown schematically in FIG. 7, causes movement of the blocking element 6 from the blocking position into the nonblocking position (shown by the broken line in FIG. 7). In accordance with an exemplary embodiment of the invention, the opening drive is an electric motor.

In the exemplary embodiment shown, the ratchet kinematics 5 has a transmission lever 8 which can be swivelled around a swivelling axis 7. By resetting the latch 2 out of the main locked position in the direction of the open position (to the right in FIG. 1), the transmission lever 8 can be moved to the right. When the ratchet arrangement 3 is in the holding position, the blocking element 6 blocks the transmission lever 8 so that resetting of the latch 2 is blocked.

Figure 5:
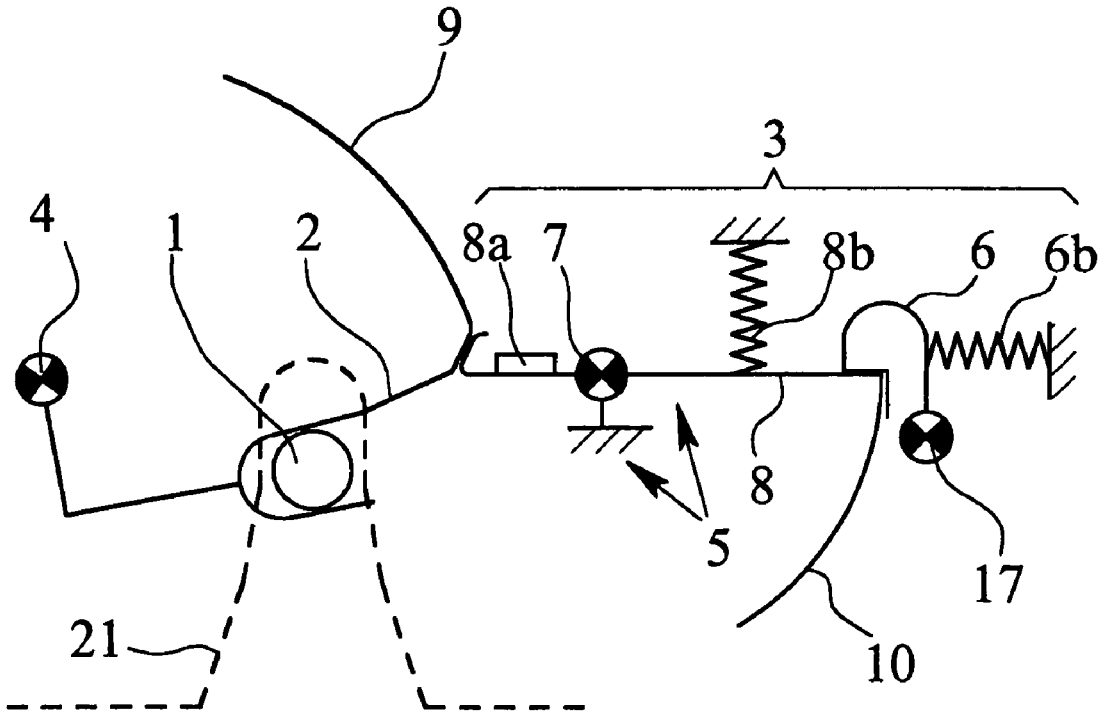

Another possible embodiment of the aforementioned principle that can be implemented with few components is shown schematically in FIG. 5. The transmission lever 8 can engage the blocking element 6 here as well as the latch 2. FIG. 5 shows the latch 2 in the main locked position and the ratchet arrangement 3 in the holding position.

If, at this point, the blocking element 6 in FIG. 5 is swivelled to the right, the latch 2 is released. The resetting of the latch 2 from the main locked position shown in FIG. 5 to the right, then causes swivelling of the transmission lever 8 to the left against the pretensioning of springs 8*b*. The transmission lever 8 is kept in the deflected position by the guide surface 9 which is located on the latch 2. The blocking element 6 is likewise kept in the deflected position by another guide surface 10. As the latch 2 is subsequently moved out of the open position into the main locked position, the blocking element 6 again engages the transmission lever 8 by blocking, and thus keeps the latch 2 in the illustrated main locked position. It is advantageous here that the transmission lever 8, which is part of the ratchet kinematics 3, is made as step-down gearing since the swivelling axis 7 of the transmission lever 8 is not located in the middle, but offset on the transmission lever 8.

It should be pointed out that in accordance with the present invention, the blocking of the transmission lever 8 by the blocking element 6 is provided preferably in only one direction of the swivelling of the transmission lever 8. In certain applications, however it can be advantageous for blocking by the blocking element to prevent swivelling of the transmission lever 8 in both directions of the swivelling.

In the embodiment shown in FIGS. 1 to 4, the transmission lever 8 is coupled by motion to the latch 2. This means forced coupling between the transmission lever 8 and the latch 2 which leads to the movement of the latch 2 resulting in a corresponding movement of the transmission lever 8.

In one exemplary configuration in accordance with the present invention, for the aforementioned coupling of motion, there is an intermediate lever 11 located between the transmission lever 8 and the latch 2. The intermediate lever 11 is pivotally coupled to the latch 2 on the one hand, and to the transmission lever 8 on the other. The coupling point 12 on the latch 2 is eccentric, with respect to the swivelling axis 4 of the latch 2, and therefore spaced apart from the swivelling axis 4. Accordingly, the coupling point 13 is arranged eccentrically on the transmission lever 8 with respect to the swivelling axis 7 of the transmission lever 8.

The above described coupling between the latch 2, the intermediate lever 11 and the transmission lever 8 results in a four-bar mechanism by which the speed reduction of the ratchet kinematics 5 which is desired due to a low cost. It is especially advantageous that the speed reduction of this four-bar mechanism changes depending on the position of the transmission lever 8.

The above-described four-bar mechanism is especially advantageous if the speed reduction is especially high when the latch 2 is in the main locked position, and if the speed reduction is accordingly lower when the latch 2 is in the preliminary locked position. This is advantageous to the extent that the holding forces which occur when the latch 2 is in the main locked position, are far higher than when the latch 2 is in the preliminary locked position. The degree of speed reduction, when the latch 2 is in the main locked position, is preferably up to eight times greater than the degree of speed reduction when the latch 2 is in the preliminary locked position. Overall, the variable speed reduction of the four-bar mechanism leads to optimum use of the installation space available in the motor vehicle lock.

The present invention provides advantages with regard to the operating reliability of the motor vehicle lock if: 1) when the latch 2 is in the main locked position or when in the preliminary locked position, the force acting on the transmission lever 8 from the latch 2 via the intermediate lever 11 causes torque on the transmission lever 8 with respect to its swivelling axis 7 and, 2) if the blocking force of the blocking element 6 opposes this torque.

From FIG. 1 it can be recognized that when a force is acting from the striker 1 on the latch 2 in FIG. 1 to the bottom (for example, for a tensile force on a closed side door), a corresponding force is routed from the latch 2 via the intermediate lever 11 to the transmission lever 8. A line of action 14 of this force runs through two connecting points 12, 13. Because of line of action 14 of the force in FIG. 1, runs past the swivelling axis 7 of the transmission lever 8, a torque on the transmission lever 8 in FIG. 1, to the right, is produced. This torque is opposed by the blocking force of the blocking element 6. FIG. 1 makes it clear that the speed reduction becomes greater, the closer that the line 14 of action of the force runs to the swivelling axis 7. The two aforementioned objectives, for the purposes of an optimum compromise, can be joined to one another by suitable spacing of the line 14 of action of the force to the swiveling axis 7.

When the latch 2 is in the main locked position, a tensile force acts from the striker 1 on the latch 2 (seal counter-pressures), the aforementioned torque on the transmission lever 8 arises. This leads to the transmission lever 8 being in the position shown in FIG. 1 and defined by the blocking element 6 in the blocking position when the latch 2 is in the main locked position.

In order to ensure reliable resetting of the latch 2 out of the main locked position into the open position when the latch 2 released, in one preferred embodiment the transmission lever 8 is pretensioned and the blocking force of the blocking element 6 opposes the pretensioning of the transmission lever 8. The pretensioning can also be provided on other components of the ratchet kinematics 5. With respect to the lever ratios, it is advantageous if the transmission lever 8 is pretensioned as described. The direction of this pretensioning is shown in FIGS. 1 to 4 by the arrow 15.

Figure 2:
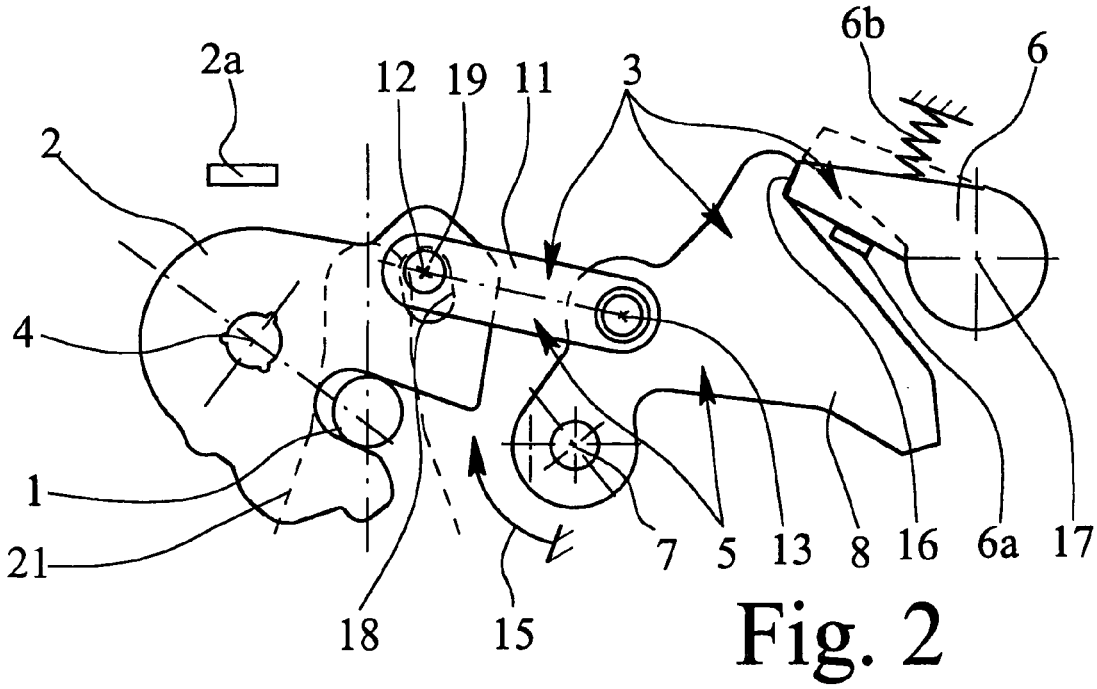
FIG. 2 shows the motor vehicle lock as shown in FIG. 1 with the latch in the preliminary locked position.
Figure 3:
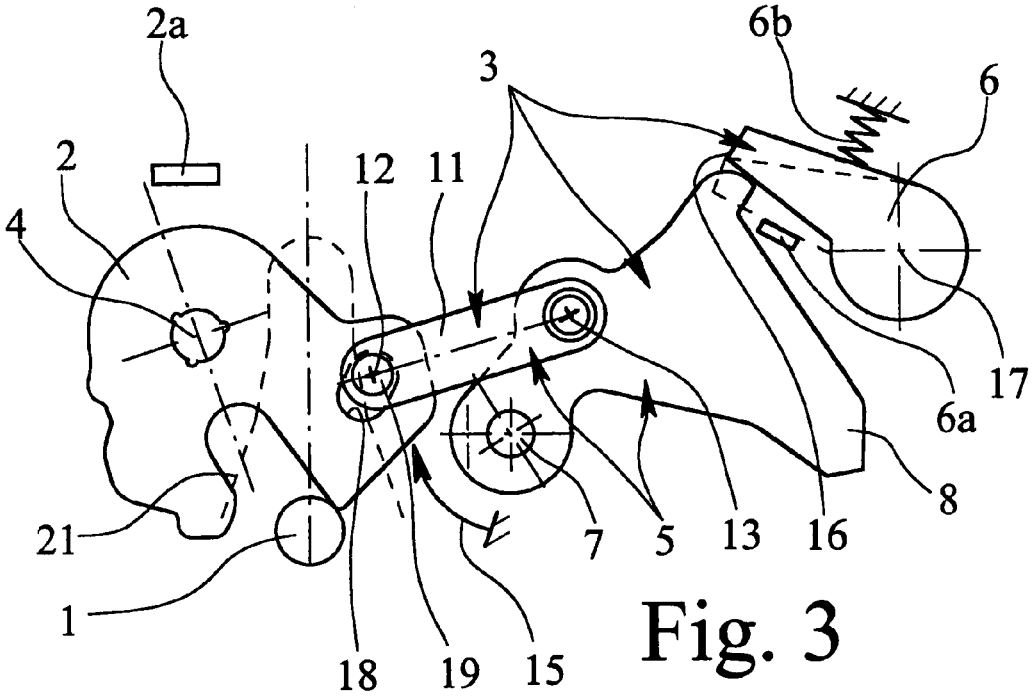
FIG. 3 shows the motor vehicle lock as shown in FIG. 1 with the latch in the open position and the ratchet arrangement in the release position.

In order to be able to transmit the aforementioned blocking force from the blocking element 6 to the transmission lever 8, the transmission lever 8, in one configuration, has a main catch 16 and a preliminary catch 16*a*. As explained above, a preliminary catch 16*a* can optionally be employed, depending on the application. The blocking element 6 can be moved to engage the transmission lever 8 by blocking via the main catch 16 and, if present, via the preliminary catch 16*a*. This is shown in FIGS. 1 and 2 for the main locked position and the preliminary locked position of the latch 2.

The blocking element 6, in one exemplary configuration, can be swivelled in the manner of a ratchet around the swivelling axis 17. There is also a stop 6*a* on which the blocking element 6 lies in the blocking position and against which the pretensioning of a spring 6*b*, which acts on the blocking element 6. When the ratchet arrangement 3 is in the holding position the blocking element 6, as described above, engages the transmission lever 8 by blocking. This configuration of the blocking element 8 in the manner of a ratchet leads to a structurally very simple implementation.

Figure 4:
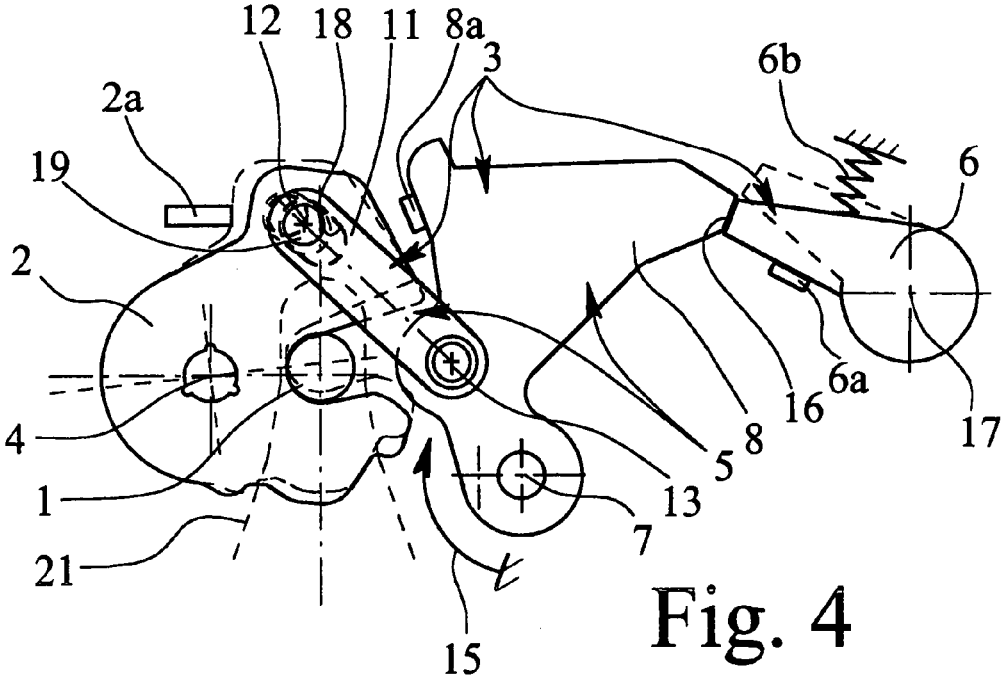
FIG. 4 shows the motor vehicle lock as shown in FIG. 1 with the latch in the overstrike position (broken line), FIG. 5 schematically shows another motor vehicle lock with the latch and ratchet arrangement.

In one exemplary configuration, the coupling of the intermediate lever 11 to the latch 2 has a trip-free mechanism. This makes possible the movement of the latch 2 out of the main locked position into an overstroke position which is on the other side of the main locked position, viewed from the open position, without necessarily entailing the movement of the transmission lever 8. The overstroke position of the latch 2 is shown in FIG. 4 by the broken line. The overstroke position of the latch 2 is briefly assumed when, for example, the side door of a motor vehicle is slammed shut. The transmission lever 8 during this time is pressed against the stop 8*a* into its overstroke position so that the blocking element 6 can engage the blocking position.

The aforementioned trip-free mechanism is implemented by the latch 2 having an oblong hole 18 and the intermediate lever 11 having a journal 19 which is located in the oblong hole 18. When the latch 2 is moved from the main locked position into the overstroke position, the journal 19 runs in the oblong hole 18, as is shown in FIG. 4.

In order to ensure adequate coupling between the latch 2 and the ratchet kinematics 5, especially for resetting the latch 2 out of the main locked position into the open position, and the above described fixing of the transmission lever 8 on the stop 8*a* for an overstroke of the latch 2, and furthermore, in order to prevent uncontrolled running of the journal 19 in the oblong hole 18, the intermediate lever 11 is pretensioned against the latch 2 such that the latch 2 can only be moved against the pretensioning into the overstroke position. This pretensioning can be accomplished by a pretensioning spring 20, as shown in FIG. 1.

With the approach as set forth in the present invention, advantages with respect to protection against theft can be achieved. One preferred configuration calls for the motor vehicle lock to have an inlet slot 21 and for the blocking element 6 for protection against theft to be located in the motor vehicle lock such that the blocking element 6 cannot be reached from the inlet slot 21 or can only be reached with difficulty. This means that by interposing the ratchet kinematics 5 it is now possible to arrange the blocking element 6 in the motor vehicle lock where it is protected against unauthorized interventions form the inlet slot 21.

Figure 6:
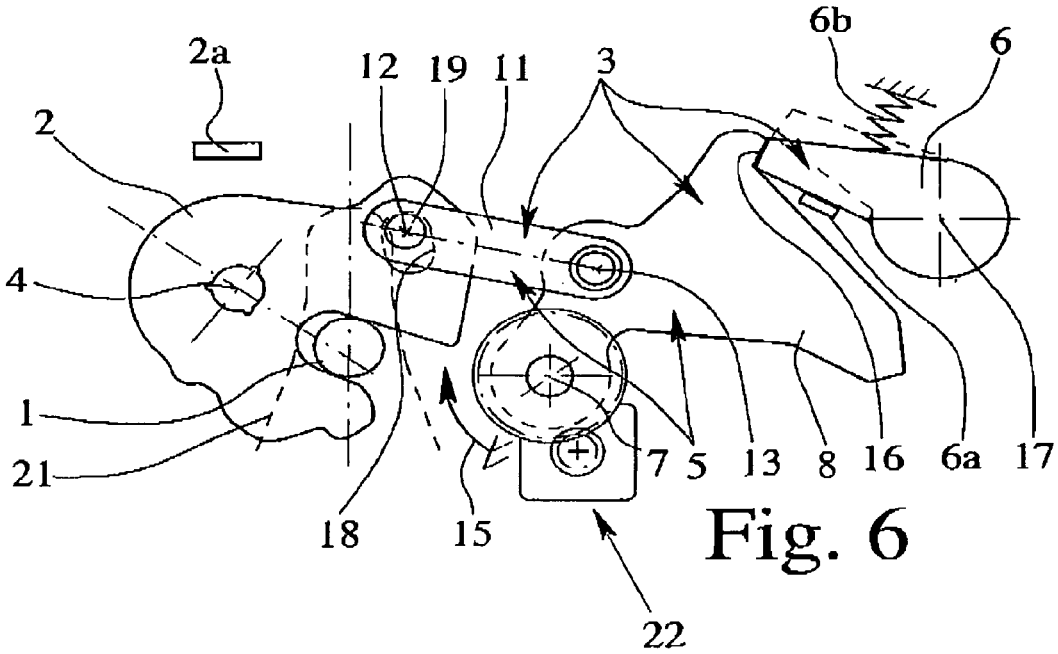
FIG. 6 shows the motor vehicle lock with the latch as shown in FIG. 2 with an auxiliary locking device.

Furthermore, the approach as claimed in the invention also offers an especially compact implementation of a locking aid. According to this configuration there is an auxiliary locking drive 22, seen in FIG. 6, which is coupled to the transmission lever 8. The latch 2 can be moved into the main locked position by means of the auxiliary locking drive 22 that rotates the transmission lever 8, as would be understood by those of ordinary skill in the art. The necessary prerequisite for this is the above explained coupling of motion between the transmission lever 8 and the latch 2.

What is claimed is:

1. Motor vehicle lock comprising:

a latch that is swivelable around a swivelling axis and moveable into an open position and at least into a main locked position; and a ratchet arrangement movable into at least one holding position and into a release position, and the ratchet arrangement keeping the latch in the main locked position when in the at least one holding position, the ratchet arrangement further including, ratchet kinematics, wherein the ratchet kinematics is moved by resetting the latch out of the main locked position in the direction of the open position; and and adjustable blocking element that blocks movement of the ratchet kinematics when the ratchet arrangement is in the at least one holding position, thereby blocking the resetting of the latch, wherein the ratchet kinematics further comprises a transmission lever that is swivelable around a second swivelling axis, wherein by swivelling the latch out of the main locked position in the direction of the open position, the transmission lever can be moved and, when the ratchet arrangement is in the at least one holding position, the blocking element blocks the transmission lever, wherein the transmission lever is coupled to the latch, and wherein an intermediate lever couples the transmission lever and the latch and, wherein the intermediate lever is pivotally coupled to the latch and to the transmission lever and, is coupled eccentrically with regard to the respective swivelling axis of the latch.

2. Motor vehicle lock as claimed in claim 1 wherein the motor vehicle lock has a motorized opening drive and wherein the release of the latch can be triggered by a motor.

3. Motor vehicle lock as claimed in claim 2, wherein the motorized opening drive is an electric motor.

4. Motor vehicle lock as claimed in claim 1 wherein when the latch is in the main locked position the force acting on the transmission lever from the latch via the intermediate lever causes torque on the transmission lever with respect to its swivelling axis and wherein the blocking force of the blocking element opposes the torque on the transmission lever.

5. Motor vehicle lock as claimed in claim 1 wherein the transmission lever is pretensioned and wherein the blocking force of the blocking element opposes the pretensioning of the transmission lever.

6. Motor vehicle lock as claimed in claim 1 wherein the transmission lever further comprises:

at least one main catch, wherein the blocking element can be moved to engage the transmission lever by blocking at least via the main catch.

7. Motor vehicle lock as claimed in claim 1 wherein the blocking element is swivelable around a third swivelling axis and when the ratchet arrangement is in the holding position, the blocking element engages and blocks the transmission lever.

8. Motor vehicle lock as claimed in claim 1 further comprising:

an auxiliary locking drive, wherein the auxiliary locking drive is coupled to the transmission lever and wherein the latch can be moved into the main locked position by the auxiliary locking drive via the transmission lever.

9. Motor vehicle lock as claimed in claim 1 wherein the coupling of the intermediate lever to the latch includes a trip-free mechanism and wherein movement of the latch out of the main locked position into an overstroke position, on the other side of the main locked position viewed from the open position, is possible without moving the transmission lever.

10. Motor vehicle lock as claimed in claim 9, wherein the intermediate lever is pretensioned against the latch such that the latch can be moved into the overstroke position against the pretensioning.

11. Motor vehicle lock as claimed in claim 1 further comprising: an inlet slot and wherein the blocking element, for protection against theft, is located in the motor vehicle lock such that the blocking element cannot be reached from of the inlet slot.

12. Motor vehicle lock comprising:

a latch that is swivelable around a swivelling axis and moveable into an open position and at least into a main locked position; and a ratchet arrangement movable into at least one holding position and into a release position, and the ratchet arrangement keeping the latch in the main locked position when in the at least one holding position, the ratchet arrangement further including, ratchet kinematics, wherein the ratchet kinematics is moved by resetting the latch out of the main locked position in the direction of the open position; and an adjustable blocking element that blocks movement of the ratchet kinematics when the ratchet arrangement is in the at least on holding position, thereby blocking the resetting of the latch, wherein the ratchet kinematics further comprises step-down gearing, wherein a blocking force applied by the blocking element to block the latch is reduced by the step-down gearing, and a transmission lever that is swivelable around a second swivelling axis, wherein by swivelling the latch out of the main locked position in the direction of the open position the transmission lever can be moved and, when the ratchet arrangement is in the at least one holding position the blocking element blocks the transmission lever, wherein the transmission lever is coupled to the latch, wherein an intermediate lever couples the transmission lever and the latch and wherein the intermediate lever is pivotally coupled to the latch and to the transmission lever and, is coupled eccentrically with regard to the respective swivelling axis of the latch.

13. Motor vehicle lock as claimed in claim 12 wherein, when the latch is in the main locked position, a degree of reduction of the ratchet kinematics is higher than when the latch is in a preliminary locked position.

14. Motor vehicle lock as claimed in claim 12, wherein the latch is in the main locked position, the force acting on the transmission lever from the latch via the intermediate lever causes torque on the transmission lever with respect to its swivelling axis, and wherein the blocking force of the blocking element opposes the torque.

15. Motor vehicle lock as claimed in claim 12, wherein the transmission lever is pretensioned and wherein the blocking force of the blocking element opposes the pretensioning of the transmission lever.

16. Motor vehicle lock as claimed in claim 12, wherein the transmission lever further comprises:

at least one main catch, wherein the blocking element can be moved to engage the transmission lever by blocking at least via the main catch.

17. Motor vehicle lock as claimed in claim 12, wherein the blocking element is swivelable around a third swivelling axis and when the ratchet arrangement is in the holding position the blocking element engages and blocks the transmission lever.

18. Motor vehicle lock as claimed in claim 12, further comprising:

an auxiliary locking drive, wherein the auxiliary locking drive is coupled to the transmission lever and wherein the latch can be moved into the main locked position by the auxiliary locking drive via the transmission lever.

19. Motor vehicle lock as claimed in claim 12, wherein the coupling of the intermediate lever to the latch includes a trip-free mechanism and wherein movement of the latch out of the main locked position into an overstroke position on the other side of the main locked position viewed from the open position, is possible without moving the transmission lever.

20. Motor vehicle lock as claimed in claim 19 wherein the intermediate lever is pretensioned against the latch such that the latch can be moved into the overstroke position against the pretensioning.

21. Motor vehicle lock as claimed in claim 12, further comprising:

a motorized opening drive, wherein the release of the latch can be triggered by a motor.

22. Motor vehicle lock as claimed in claim 21 wherein the motorized opening drive is an electric motor.

23. Motor vehicle lock as claimed in claim 14 further comprising:

a motorized opening drive, wherein the release of the latch can be triggered by a motor.

24. Motor vehicle lock as claimed in claim 23 wherein the motorized opening drive is an electric motor.

25. Motor vehicle lock as claimed in claim 19 further comprising:

a motorized opening drive, wherein the release of the latch can be triggered by a motor.

26. Motor vehicle lock as claimed in claim 25 wherein the motorized opening drive is an electric motor.

* * * * *